US010199725B2

(12) United States Patent
Elsaadani et al.

(10) Patent No.: US 10,199,725 B2
(45) Date of Patent: Feb. 5, 2019

(54) METHODS AND DEVICES FOR REDUCING PASSIVE INTERMODULATION IN RF ANTENNAS

(71) Applicant: ALCATEL-LUCENT SHANGHAI BELL CO., LTD., Pudong Jinqiao, Pudong New Area, Shanghai (CN)

(72) Inventors: Asaad R. Elsaadani, Meriden, CT (US); Timothy Bernhardt, Cheshire, CT (US); Peter A. Casey, Clinton, CT (US); Chenguang Zhou, Shanghai (CN); Peng Cui, Shanghai (CN); Gaetan G. F. Fauquert, Lannion (FR); Eric Callec, Lannion (FR)

( * ) Notice: Subject to any disclaimer, the term of this patent is extended or adjusted under 35 U.S.C. 154(b) by 1014 days.

(21) Appl. No.: 14/360,683

(22) PCT Filed: Nov. 12, 2013

(86) PCT No.: PCT/CN2013/086981
§ 371 (c)(1),
(2) Date: May 27, 2014

(87) PCT Pub. No.: WO2015/070380
PCT Pub. Date: May 21, 2015

(65) Prior Publication Data

US 2016/0020514 A1 Jan. 21, 2016

(51) Int. Cl.

| | |
|---|---|
| ***H01Q 3/02*** | (2006.01) |
| ***H01Q 1/52*** | (2006.01) |
| ***H01Q 3/32*** | (2006.01) |

(52) U.S. Cl.
CPC ..... *H01Q 1/52* (2013.01); *H01Q 3/32* (2013.01)

(58) Field of Classification Search
CPC ..... H01Q 3/32; H01Q 3/38
USPC ..... 342/157, 359, 372, 374; 343/714, 715, 343/754
See application file for complete search history.

(56) References Cited

U.S. PATENT DOCUMENTS

| | | | | |
|---|---|---|---|---|
| 5,798,675 | A | 8/1998 | Drach | |
| 6,239,744 | B1 | 5/2001 | Singer et al. | |
| 2010/0201590 | A1* | 8/2010 | Girard | H01Q 1/246 343/766 |
| 2013/0115891 | A1 | 5/2013 | Klein | |
| 2013/0116011 | A1 | 5/2013 | Lee et al. | |
| 2016/0352011 | A1* | 12/2016 | Duan | H01Q 3/32 |

FOREIGN PATENT DOCUMENTS

WO WO2013/079552 A1 6/2013

* cited by examiner

*Primary Examiner* — Dao L Phan
(74) *Attorney, Agent, or Firm* — Capitol Patent & Trademark Law Firm, PLLC

(57) ABSTRACT

Systems and related methods for reducing passive intermodulation (PIM) include a combination of an antenna control unit (ACU) and a remote electrical tilt (RET) system. The ACU may be used to generate rotational motion of an output drive shaft in response to an input tilt control signal. The RET system couples to the output drive shaft of the ACU and may be used to convert the rotational motion into translational motion for modifying a phase shift of an antenna beam. PIM may be substantially eliminated by providing electrical isolation between the ACU and RET system in the form of a non-conductive connector that engages the draft shaft of the ACU.

23 Claims, 4 Drawing Sheets

METHODS AND DEVICES FOR REDUCING PASSIVE INTERMODULATION IN RF ANTENNAS

RELATED APPLICATION

This application is related to U.S. patent application Ser. No. 13/669,040 ("'040 application") and incorporates by reference herein, as if set forth in full herein, those parts of the '040 application that are consistent with the text and drawings disclosed herein. In the event any part is inconsistent, the text and drawings of the instant application govern.

Beam tilt adjustment is used in RF antenna systems for a variety of reasons, including minimizing inter-signal interference and maximizing network capacity. Antennas with "electrical tilt" functionality enable network operators to tilt the elevation beam pointing direction of an antenna within mechanically tilting the antenna and without changing the visual appearance of the site. In particular, an electrical tilt arrangement utilizes a set of phase shifters that are linked, via a screw mechanism, to the antenna. The rotation of the screw mechanism causes a change in phase between radiating elements inside the antenna, resulting in the beam emitted from the antenna to tilt "up" or "down" relative to the mechanical boresite of the antenna.

Many installations utilize a "remote electrical tilt" (RET) configuration where an antenna control unit (ACU) is attached to (or installed within) the antenna and is used to initiate the movement of the shaft and create the phase changes necessary to provide the beam tilt. The ACU is controlled by remotely-generated signals that are used to activate an electro-mechanical devices (such as a stepper motor) to create a mechanical output control for the phase shifters.

However, it has been found that the typical metal-to-metal contact between the ACU output drive shaft and the phase shifter screw mechanism creates passive intermodulation (PIM), which is a particular concern for high power RF antenna installations.

SUMMARY

The present invention addresses this concern by providing electrical isolation between the antenna control unit (ACU) and endless screw system (ESS) components of an antenna's remote electrical tilt (RET) system without compromising the integrity of the mechanical connection that is necessary to generate the movement of the phase shifting elements of the antenna.

In accordance with the present invention, a non-conductive connector is coupled to the ESS component of the RET system. The non-conductive connector mates with an output drive shaft of the ACU while maintaining electrical isolation between the ACU and ESS components. The non-conductive connector imparts rotational motion to the ESS in a manner that creates linear motion of the associated phase shifter network.

In one embodiment, the non-conductive connector comprises a non-conductive insert that is disposed within a conventional female connector on the ESS, where the insert is formed to exhibit an inner surface that properly mates with the output drive shaft (for example, hexagonal) of the ACU. The outer surface of the insert may be shaped to prevent motion between a conventional female connector geometry and the insert (i.e., an irregular surface that prevents movement between the insert and the connector as the insert rotates).

In an alternative embodiment, a non-conductive connector end is over-molded onto a termination of the ESS, where the over-molded element is also formed to exhibit the specific inner surface geometry that may mate with the output drive shaft of the ACU.

One exemplary embodiment of the present invention takes the form of a system for generating electrical tilt, the system comprising an antenna control unit for controlling rotational motion of an output drive shaft in response to an input tilt control signal and an endless screw system coupled to the output drive shaft. The endless screw system comprises an endless screw, a phase shifting element mounted on the endless screw, and a non-conductive connector formed on an end termination of the endless screw, the non-conductive connector designed to engage the output drive shaft of the antenna control unit. The non-conductive connector is formed of a material (e.g., a polymer material) that creates an electrically isolated connection between the output drive shaft and the endless screw.

The non-conductive connector may comprise a molded connector component configured over, and attached to, an end portion of the endless screw, to form an over-molded non-conductive connector, with an interior surface of the molded connector component configured to engage the output drive shaft.

In such an exemplary system the non-conductive connector may further comprise a metallic outer housing attached to the endless screw and a non-conductive insert (e.g., polymer material) disposed within the metallic outer housing, where the non-conductive insert may be configured to exhibit an interior surface that matches a shape of the output drive shaft.

Further, the non-conductive insert may comprise a hexagonal-shaped inner surface for engaging a hexagonal output drive shaft.

The metallic outer housing may comprise a shaped inner surface. An outer surface of the non-conductive insert may be configured to engage with the shaped inner surface of the metallic outer housing to prevent relative rotation between the metallic outer housing and the non-conductive insert. The metallic outer housing may comprise an essentially cylindrical inner surface and the non-conductive insert may comprise an essentially cylindrical outer surface.

In yet a further embodiment, the system may further comprise at least one fixing pin disposed between the metallic outer housing and the non-conductive insert to prevent relative rotation between the metallic outer housing and the non-conductive insert. In such an embodiment, the inner surface of the metallic outer housing and the outer surface of the non-conductive insert may each comprise at least one slot, where the respective slots align and are used to support the at least one fixing pin.

Regarding the endless screw, in one embodiment it may comprise at least one raised feature configured along an end portion, where a molded connector component encases the at least one raised feature to secure attachment of a molded connector component to the endless screw. The molded connector component may comprise a clam shell configuration disposed to surround the end portion of the endless screw and attach thereto.

In an alternative embodiment, a system for reducing passive intermodulation in a remote electrical tilt system may comprise many of the same components as the system described above, though the antenna control unit may, or may not be, included.

In addition to systems, the present invention also provides related methods for controlling the electrical tilt of a beam radiating from an antenna. For example, one exemplary method may comprise: (i) providing an endless screw system comprising an endless screw, a phase shifting element mounted on the endless screw and a non-conductive connector disposed at an end termination of the endless screw; (ii) providing an antenna control unit for controlling rotational motion of an output drive shaft in response to an input tilt control signal; (iii) engaging the output drive shaft with the non-conductive connector of the endless screw system in an electrically isolated configuration and (iv) transmitting a remotely-generated input tilt control signal to the antenna control unit for rotating the output drive shaft and connected endless screw to control the electrical tilt of the beam.

Such a method may further comprise: (v) inserting a non-conductive insert into an outer connector housing at the end termination of the endless screw, and/or (vi) over-molding a non-conductive material over the end termination of the endless screw to form the non-conductive connector.

Other and further embodiments and details and of the present invention will become apparent during the course of the following discussion and by reference to the accompanying drawings.

BRIEF DESCRIPTION OF THE DRAWINGS

Referring now to the drawings, where like elements represent like parts in several views.

DETAILED DESCRIPTION, INCLUDING EXAMPLES

In some RF antenna systems, the remote electrical tilt (RET) system (i.e., the phase shifter mechanism) takes the form of a phase control element mounted on an endless screw. The endless screw accepts a rotational mechanical output from the antenna control unit (ACU), but is fixed so that it cannot move longitudinally as it rotates. Instead, the rotation of the endless screw provides translational movement of the mounted phase control element back and forth along the screw (depending on the direction of the rotation), where the translational movement of the phase control element shifts the phase of the beam radiating from the antenna.

Figure 1:
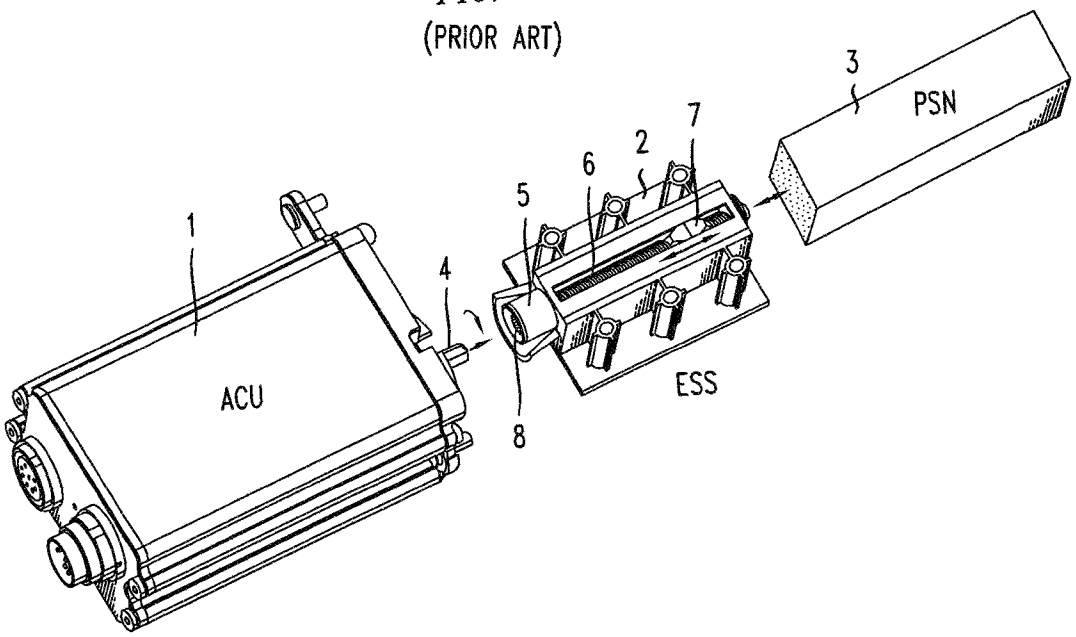
FIG. 1 (PRIOR ART)
FIG. 1 illustrates a conventional remote electrical tilt (RET) system for providing phase shifting for an RF antenna.
Figure 2:
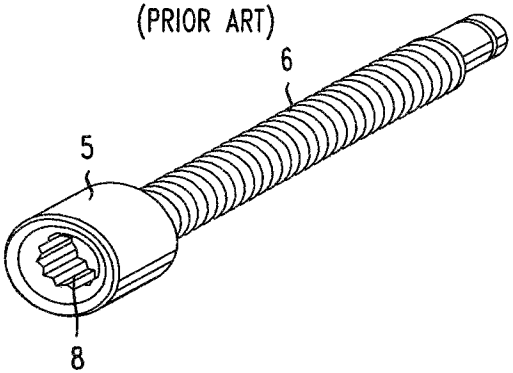
FIG. 2 (PRIOR ART)
FIG. 2 is an enlarged view of a portion of the endless screw system (ESS) component of the RET system of FIG. 1, showing in detail in an interior hex shape of the female connector.

FIG. 1 illustrates a typical prior art RET system, consisting of an ACU 1, ESS 2 and a phase shifter network (PSN) 3. It is to be noted that these elements are not drawn to scale (even with respect to each other), and in typical implementations ESS 2 may be mounted on PSN 3. Remotely-generated control signals are received by ACU 1 and are used to activate an included electro-mechanical device (i.e., stepper motor, not shown) to create a rotational, mechanical output. Referring to FIG. 1, the output from ACU 1 may take the form of the rotation of an output drive shaft 4. ESS 2 is coupled to ACU 1 at drive shaft 4 and translates rotational motion of output drive shaft 4 into linear motion used by PSN 3 to create the desired phase shift in the antenna system. In particular, when output drive shaft 4 engages a female connector 5 of an endless screw 6 within ESS 2, the rotation of drive shaft 4 is transferred into a linear motion of a phase shifter element 7 along endless screw 6. The linear movement of phase shifter element 7 is then used by PSN 3 to modify the phase shift of the associated antenna elements, creating a change in the electrical tilt in the radiation beam emitted by the antenna. FIG. 2 is an enlarged view of female connector 5 of endless screw 6, showing in particular an exemplary hexagonal form of inner diameter 8 of female connector 5. In this case, output drive shaft 4 of ACU 1 may also be hexagonal in form so that it may properly engage with connector 5.

Inasmuch as all of these components are formed of metal, a transient loss of contact between drive shaft 4 and female connector 5 (or any change that effects contact between these components) may introduce noise into the system, perturbing the RF field and creating what is referred to as "passive intermodulation" (PIM). PIM may be caused by, for example, inconsistent metal-to-metal contact between RF connector surfaces. While PIM was of little concern in the past, the use of higher is transmitter power levels in today's systems makes the presence of PIM more problematic. In the prior art arrangement shown in FIGS. 1 and 2, the metal-to-metal contact between output drive shaft 4 and female connector 5 is considered a prime area where PIM may develop.

Figure 3:
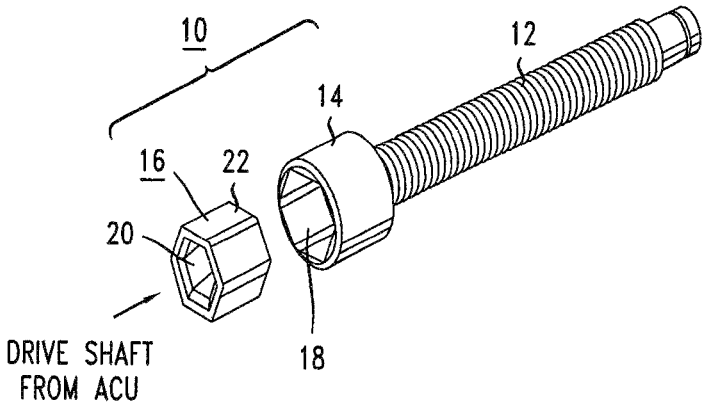
FIG. 3 is an exploded view of one embodiment of the present invention, illustrating a non-conductive insert for providing electrical isolation between the ACU and ESS components of an antenna's RET system.

FIG. 3 illustrates, in an exploded view, an exemplary arrangement formed in accordance with an embodiment of the present invention to mitigate the presence of PIM by providing electrical isolation between an ACU and an ESS within a RET system of a base station RF antenna. In accordance with the present invention, electrical isolation may be achieved by utilizing a non-conductive connector as the element within the ESS that engages the (metallic) output drive shaft of the ACU. Thus, by utilizing a non-conductive connector, the possibility of a metal-to-metal contact (and resultant creation of PIM) between the ACU and the ESS is significantly reduced.

Figure 4:
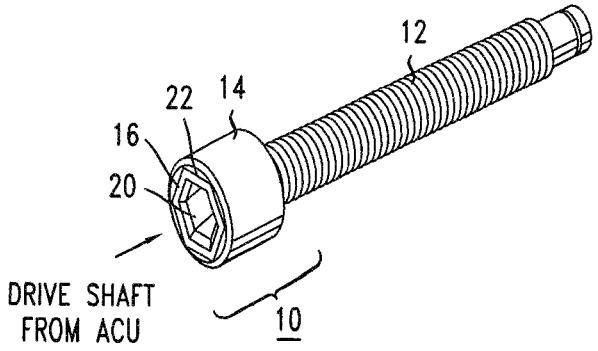
FIG. 4 shows the same embodiment as FIG. 3, in this case with the insert shown as in place within an end termination of an endless screw.

In particular, FIG. 3 illustrates a portion of an exemplary ESS configuration, in this case taking the form of a non-conductive connector termination 10 coupled to an endless screw 12 (where in most cases endless screw 12 may be formed of a suitable metallic material). In this embodiment, non-conductive connector termination 10 comprises an outer connector housing 14 and a non-conductive insert 16 which is configured to fit into the interior 18 of outer connector housing 14, as shown in FIG. 4. Outer connector housing 14 is typically metallic and may, indeed, be formed as an integral part of metallic endless screw 12. Non-conductive insert 16 may be formed of any suitable type of non-conductive material, such as a polymer. Preferably, the material used for non-conductive insert 16 should not be a rigid plastic (which could crack or break) or a material that is too pliable (so as to not maintain contact with the drive shaft of an associated ACU (not shown).

In accordance with the present invention, the interior 20 of non-conductive insert 20 may be configured in a particular shape (in this example, hexagonal) that may mate with and engage the output drive shaft from an associated ACU. Thus, when the output drive from the ACU is an hexagonal-shaped rotating member, interior 20 of non-conductive insert 16 is also exhibit a hexagonal topology.

Operating as part of a system for controlling electrical tilt of a beam radiating from an antenna, an ACU may receive an input tilt control signal which it uses to impart rotational motion to an associated output draft shaft. The rotation of the output drive shaft rotates the engaged non-conductive connector termination 10, which in turn causes rotation of endless screw 12. The rotation of endless screw 12 creates linear motion of a phase shifter element (not shown in FIGS. 3 and 4) mounted on endless screw 12 (such as phase shifter element 7 shown in FIG. 1). Inasmuch as the connection between the output drive shaft and connection termination 10 is non-conductive, there is electrical isolation between these two components and, therefore, a reduction in PIM.

In the particular embodiment shown in FIGS. 3 and 4, exterior surface 22 of non-conductive insert 16 may be configured with the same connector topology (in this case, hexagonal), because insert 16 is being used in conjunction with a conventional female connector (hex connector) housing 14. By maintaining the same geometry between the interior surface of housing 14 and the outer surface of non-conductive insert 16, there is little chance of any rotation (slippage) occurring between connector housing 14 and non-conductive insert 16 when the output drive shaft from the ACU is engaged with insert 16.

Figure 5:
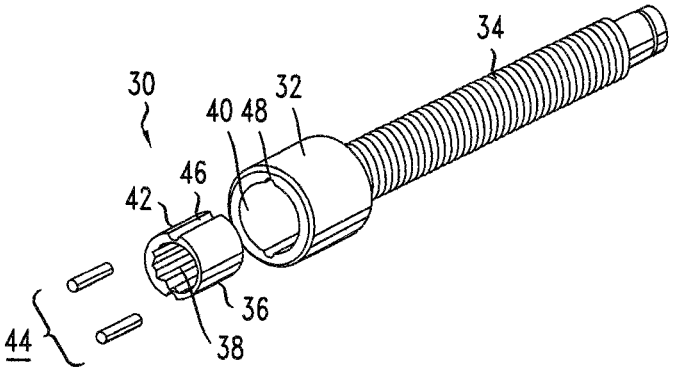
FIG. 5 is an exploded view of an alternative embodiment of the present invention, using fixing pins with a non-conductive insert to prevent motion between the 3D insert and the female connector.
Figure 6:
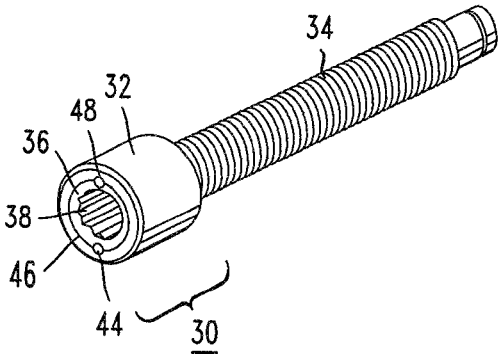
FIG. 6 is a view of the arrangement of FIG. 5, showing the non-conductive insert as positioned within the endless screw.

FIGS. 5 and 6 illustrate an alternative embodiment of an electrical isolation arrangement for an RET system in accordance with the present invention. In this case, electrical isolation is provided by a non-conductive connector arrangement 30 that comprises an outer connector housing 32 that is attached to an endless screw 34. As with the embodiment discussed above in association with FIGS. 3 and 4, it is likely that outer connector housing 32 is metallic (with the possibility that housing 32 and endless screw 34 are machined from a single piece of metal). As shown, connector arrangement 30 further comprises a non-conductive insert 36, which is configured as an interior topology 38 that may engage with the output drive from an associated ACU (shown in this case as a hexagonal geometry) and provide the desired electrical isolation between the ACU and the RET system. Again, this electrical isolation is provided by eliminating the metal-to-metal contact between the output drive shaft of the ACU and the connector portion of the ESS.

In contrast to the configuration shown in FIGS. 3 and 4, outer connector housing 32 of FIGS. 5 and 6 is shown as having a relatively smooth, circular interior surface 40. Similarly, non-conductive insert 36 is shown as having a relatively smooth, circular exterior surface 42. These components may be less complex to manufacture than those included in the embodiment of FIGS. 3 and 4 by virtue of their simpler geometries. However, the lack of engagement between the two surfaces may result in rotation between insert 36 and outer connector housing 32 as insert 36 rotates with the drive shaft from the ACU. In order to minimize the opportunity for insert 36 to rotate (i.e., "slip") relative to outer housing 32, a pair of fixing pins 44 may be used (as shown in FIGS. 5 and 6). As shown in FIG. 5, fixing pins 44 are configured to be positioned between slots 46 formed on outer surface 42 of insert 36 and slots 48 formed on inner surface 40 of outer housing 32. Inasmuch as pins 44 engage both outer housing 32 and insert 36, they keep insert 36 from rotating with respect to housing 32.

While the embodiments of FIGS. 5 and 6 illustrate the use of a pair of fixing pins, it is to be understood that various alternative configurations may use any suitable number of fixing pins (including a single pin).

In the above-described embodiments, both the outer housing of the connector and the endless screw may typically comprise metal, and may be configured as a single, monolithic component. In an alternative embodiment the outer housing of the connector may comprise a non-conductive material that provides a desired amount of electrical isolation between the ACU (not shown) and the ESS of the RET system (see FIGS. 7-9 discussed below).

Figure 7:
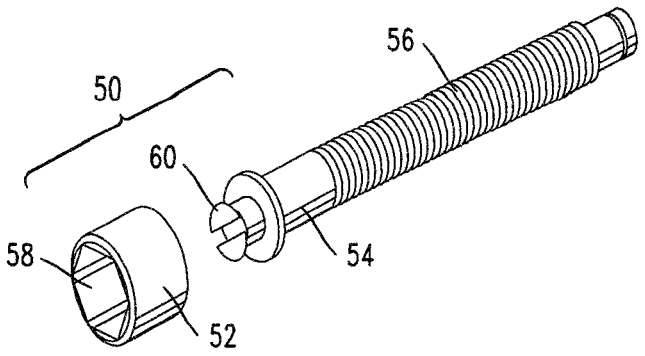
FIG. 7 illustrates, an exploded diagram, another embodiment of the present invention, in this case including a non-conductive female hex connector that is over-molded onto a first end portion of an endless screw.

Referring to FIG. 7, a non-conductive connector arrangement 50 is shown as comprising a non-conductive connector housing 52 that is over-molded onto an end termination 54 of endless screw 56. As shown, non-conductive connector housing 52 comprises an interior surface 58 (e.g., hex-shaped) that engages with the output drive shaft of an associated ACU (not shown). By virtue of molding non-conductive housing component 52 onto raised features (such as features 60) of end termination 54, component 52 may remain fixed in place with respect to endless screw 56 and thus translate the rotational motion of the ACU output drive into translation movement of endless screw 56.

Figure 8:
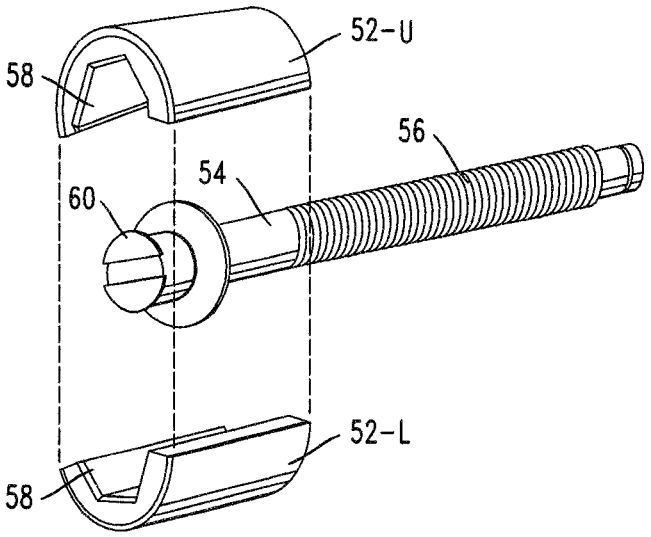
FIG. 8 is an enlarged view of an end portion of the arrangement of FIG. 7, showing a specific type of over-molding and the use of raised features on the endless screw for attaching to the molding material.
Figure 9:
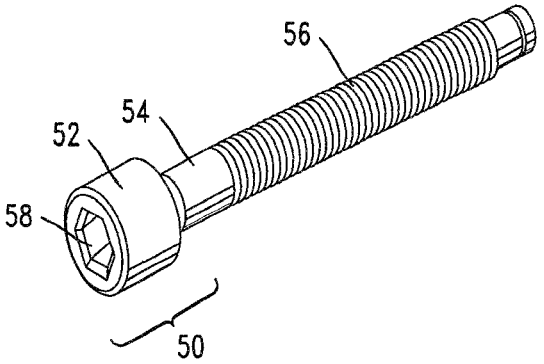
FIG. 9 illustrates a position of an over-molded non-conductive connector in place on an endless screw according to another embodiment of the present invention.

FIG. 8 illustrates one exemplary over-molding process, where connector housing 52 comprises an upper half 52-U and a lower half 52-L which may then be disposed to surround end termination 54 (i.e., in a "clam shell" type of manufacture) and be heat-treated to be permanently fixed in place. Other methods of molding non-conductive connector housing 52 onto endless screw 56 are possible, and all are considered as falling within the scope of the present invention. FIG. 9 illustrates non-conductive connector arrangement 50 with over-molded, non-conductive housing connector 52 positioned over and in physical contact with end termination 54 of endless screw 56.

Although this invention has been described in certain specific embodiments, many additional modifications and variations would be apparent to those skilled in the art. It is therefore to be understood that this invention may be practiced otherwise than as specifically described. Thus, the present embodiments of the invention should be considered in all respects as illustrative and not restrictive, the scope of the invention to be determined by the appended claims and their equivalents.

What is claimed is:

1. A system for controlling the electrical tilt of a beam radiating from an antenna comprising:

an antenna control unit for controlling rotational motion of an output drive shaft in response to an input tilt control signal; and an endless screw system coupled to the output drive shaft, the endless screw system comprising an endless screw, a phase shifting element mounted on the endless screw, and a non-conductive connector disposed at an end termination of the endless screw, the non-conductive connector for engaging the output drive shaft in an electrically isolated configuration.

2. The system as in claim 1 wherein the non-conductive connector of the endless screw system comprises a metallic outer housing attached to the endless screw and a non-conductive insert disposed within the metallic outer housing.

3. The system as in claim 2 wherein the non-conductive insert is configured to exhibit an interior surface that matches a shape of the output drive shaft.

4. The system as in claim 3 wherein the non-conductive insert comprises a hexagonal inner surface for engaging with a hexagonal output drive shaft.

5. The system as in claim 3 wherein the metallic outer housing comprises a shaped inner surface, and an outer surface of the non-conductive insert is configured to engage with the shaped inner surface of the metallic outer housing to prevent relative rotation between the metallic outer housing and the non-conductive insert.

6. The system as in claim 3 wherein the metallic outer housing comprises an essentially cylindrical inner surface and the non-conductive insert comprises an essentially cylindrical outer surface, the system further comprising at least one fixing pin disposed between the metallic outer housing and the non-conductive insert to prevent relative rotation between the metallic outer housing and the non-conductive insert.

7. The system as in claim 6 wherein the inner surface of the metallic outer housing and the outer surface of the non-conductive insert each comprise at least one slot, where the respective slots align and are used to support the at least one fixing pin.

8. The system as in claim 2 wherein the non-conductive insert comprises a polymer material.

9. The system as in claim 1 wherein the non-conductive connector comprises a molded connector component configured over, and attached to, an end portion of the endless screw, to form an over-molded non-conductive connector, with an interior surface of the molded connector component configured to engage the output drive shaft.

10. The system as in claim 9 wherein the endless screw comprises at least one raised feature along the end portion, the molded connector component encasing the at least one raised feature to secure the attachment of the molded connector component to the endless screw.

11. The system as in claim 9 wherein the molded connector component comprises a clam shell configuration disposed to surround the end portion of the endless screw and attach thereto.

12. The system as in claim 9 wherein the non-conductive connector is formed of a polymer material.

13. A system for reducing passive intermodulation in a remote electrical tilt system comprising:

an endless screw, a phase shifting element mounted on the endless screw, and a non-conductive connector configured on an end termination of the endless screw, the non-conductive connector for engaging an output drive shaft of an associated antenna control unit in an electrically isolated configuration.

14. The system as in claim 13 wherein the non-conductive connector comprises a metallic outer housing attached to the endless screw and a non-conductive insert disposed within the metallic outer housing.

15. The system as in claim 14 wherein the non-conductive insert comprises an interior surface that matches a shape of an associated antenna control unit output drive shaft.

16. The system as in claim 15 wherein the non-conductive insert comprises a hexagonal inner surface for engaging with a hexagonal output drive shaft.

17. The system as in claim 14 wherein the metallic outer housing comprises a shaped inner surface, and an outer surface of the non-conductive insert is configured to engage with the shaped inner surface of the metallic outer housing to prevent relative rotation between the metallic outer housing and the non-conductive insert.

18. The system as in claim 14 wherein the metallic outer housing comprises an essentially cylindrical inner surface and the non-conductive insert comprises an essentially cylindrical outer surface, and the system further comprises at least one fixing pin disposed between the metallic outer housing and the non-conductive insert to prevent relative rotation between the metallic outer housing and the non-conductive insert.

19. The system as in claim 18 wherein the inner surface of the metallic outer housing and the outer surface of the non-conductive insert each comprise at least one slot where the respective slots align and support the at least one fixing pin.

20. The system as in claim 13 wherein the non-conductive connector comprises a molded connector component configured over, and attached to, an end portion of the endless screw to form an over-molded non-conductive connector, with an interior surface of the molded connector component configured to engage an output drive shaft from an associated antenna control unit.

21. A method of controlling electrical tilt of a beam radiating from an antenna, the method comprising providing an endless screw system comprising an endless screw, a phase shifting element mounted on the endless screw and a non-conductive connector disposed at an end termination of the endless screw;

providing an antenna control unit for controlling rotational motion of an output drive shaft in response to an input tilt control signal;

engaging the output drive shaft with the non-conductive connector of the endless screw system in an electrically isolated configuration; and transmitting a remotely-generated input tilt control signal to the antenna control unit for rotating the output drive shaft and connected endless screw to control the electrical tilt of the beam.

22. The method as in claim 21 wherein the method comprises inserting a non-conductive insert into an outer connector housing at the end termination of the endless screw.

23. The method as in claim 21 wherein the method comprises over-molding a non-conductive material over the end termination of the endless screw to form the non-conductive connector.

* * * * *